US011359407B2

(12) United States Patent
Kaverina

(10) Patent No.: US 11,359,407 B2
(45) Date of Patent: Jun. 14, 2022

(54) DEPRESSIBLE LOCK WITH ROTATING DISPLAY

(71) Applicant: Victoria Kaverina, Brooklyn, NY (US)

(72) Inventor: Victoria Kaverina, Brooklyn, NY (US)

( * ) Notice: Subject to any disclaimer, the term of this patent is extended or adjusted under 35 U.S.C. 154(b) by 849 days.

(21) Appl. No.: 16/222,311

(22) Filed: Dec. 17, 2018

(65) Prior Publication Data

US 2020/0190856 A1 Jun. 18, 2020

(51) Int. Cl.

| | |
|---|---|
| ***E05B 41/00*** | (2006.01) |
| ***E05B 13/10*** | (2006.01) |
| ***E05B 15/00*** | (2006.01) |
| *E05B 1/00* | (2006.01) |
| *E05B 65/00* | (2006.01) |

(52) U.S. Cl.

CPC ..... *E05B 41/00* (2013.01); *E05B 13/108* (2013.01); *E05B 15/0033* (2013.01); *E05B 1/0053* (2013.01); *E05B 65/0035* (2013.01); *E05Y 2900/132* (2013.01)

(58) Field of Classification Search

CPC .... E05B 41/00; E05B 13/108; E05B 15/0033; E05B 1/00; E05B 1/0007; E05B 1/0053; E05B 1/0084; E05B 65/0035; Y10S 292/37; Y10T 292/82

See application file for complete search history.

(56) References Cited

U.S. PATENT DOCUMENTS

| | | | | |
|---|---|---|---|---|
| 417,326 A * | 12/1889 | King | E05B 41/00 40/460 |
| 8,505,345 B2 * | 8/2013 | Sun | E05B 55/005 70/224 |
| 2006/0156770 A1 * | 7/2006 | Huang | E05B 3/065 70/224 |

FOREIGN PATENT DOCUMENTS

| | | | | |
|---|---|---|---|---|
| CN | 107939158 A * | 4/2018 | E05B 15/00 |

* cited by examiner

*Primary Examiner* — Christine M Mills
*Assistant Examiner* — Randy Deinlein
(74) *Attorney, Agent, or Firm* — Michael J. Feigin, Esq.; Feigin and Fridman LLC

(57) ABSTRACT

An indicator lock has a rotatable indicator which rotates with the depression of a button on the other side of the lock which is used to simultaneously cause a door to be locked and rotate the indicator. This is accomplished by way of a shaft which rotationally moves with the the locking button. The locking button is pressed inwards and rotates as it is pressed inwards due to a channel which is diagonally disposed relative to the direction the button is pressed. A pin extending out from a shaft of the button is in the diagonal channel and a spring adds tension to push the button and display back to the unlocked configuration. This tension is overcome when the button is pressed and the pin enters into a section of the channel which is parallel to the shaft and direction of button press.

10 Claims, 10 Drawing Sheets

DEPRESSIBLE LOCK WITH ROTATING DISPLAY

FIELD OF THE DISCLOSED TECHNOLOGY

The disclosed technology generally relates to door handles and locks, and more specifically to a door handle with a push button lock and display of lock status.

BACKGROUND OF THE DISCLOSED TECHNOLOGY

The Americans With Disabilities Act (ADA) requires various specifications to be met ensuring ease of use for even those with limited mobility. In the area of doors, this requires certain sized handles and types of locks which can be easily operated. This presents a challenge when one wants to meet these requirements while providing a sturdy door handle and offer other features that are helpful to users of doors, which, of course, is everyone. For example, no one likes to be in a bathroom and hear a door handle jiggle as someone tries to enter. In order to meet the ADA requirements for an easy to use door handle while also providing high quality and pleasant experience for the user of the door, these challenges need to be overcome.

SUMMARY OF THE DISCLOSED TECHNOLOGY

In an embodiment of the disclosed technology, a door handle has an outer section and inner section. The "inner" and "outer" sections are on either an inside or outside of a room and need not be specific to which side of a door each is on, but in embodiments, the "inner" side has the ability to lock/unlock a door which the lock is attached to, where an occupancy display window is on the "outer side". The disclosure is described using this nomenclature for consistency and ease of understanding. The outer section thus has an outer handle with a display window while the inner section has an inner handle with a locking button such as one which is depressed in order to lock the door. "Lock the door" and the like refers to an act of causing the handle on the outer side to cease functioning in a manner which will allow the door to be opened. Depressing the locking button rotates a shaft extending between the outer section and the inner section while also causing, in embodiments, a display within the display window to change from, for example, VACANT to IN-USE The depressible locking button is part of a unitary piece having both the locking button and pin in these embodiments of the disclosed technology. The locking button is at an end of an elongated stem while the pin is at an opposite end thereof and extends perpendicular to the locking button/direction of movement of the locking button in such embodiments. The pin is within a channel of a collar which is covered by the inner handle in these embodiments. The channel extends circumferentially into the collar along substantially a diagonal to the direction the locking button moves when depressed.

Depressing the locking button causes the locking button to have a simultaneous rotation and be pressed inwards relative to a door situated between the outer section and the inner section of the lock in embodiments of the disclosed technology. A tensioning spring can provide a resistive force to the rotation. The channel (which holds the slidable pin therein) can have two parts at an acute angle to one another: a) a section which is diagonal to an elongated length of the shaft and b) a section which is parallel to the elongated length of the shaft. Depressing the locking button pushes the pin within the channel into the section of the channel which is parallel to the stem in these embodiments.

Rotating the inner handle, in embodiments of the disclosed technology, causes the pin to exit from the section which is parallel into the section which is diagonal. A tension spring provides a resistive force to the turning motion of the handle and combined with the turning of the handle causes the depressible button to extend (back to its starting configuration in embodiments) and the display window to turn (meaning that the indicia or display within the display window rotates). The outer handle is substantially unturnable when the pin is in the section which is parallel to the elongated length of the shaft in embodiments of the disclosed technology, such as when the door is locked.

A door handle with a rotating display of embodiments of the disclosed technology, described another way, has an exterior side of the door handle with a display which displays a locked or unlocked status of the door handle. A stem extends to an interior side of the door handle with a push-button type lock. Pushing the push-button type lock causes the door to lock and the display to rotate to display the locked status of the door handle. Rotation of the interior side of the door handle causes simultaneously, in these embodiments, the push-button to lift away from the interior side of the door handle, and the display to rotate to show an unlocked status of the door. The stem rotates with the interior side of the door handle and carries out rotational force through a door situated between the interior side of the door handle and the exterior side of the door handle.

The interior side of the door handle houses there-within a hollow cylinder with openings at each end and a channel extending partially circumferentially around the hollow cylinder in embodiments of the disclosed technology. In such an embodiment, the push-button can be connected to an elongated stem which further has a pin extending perpendicular to the elongated stem. The pin extends through the channel in such embodiments. The channel can be one which has two sections joined together as a unitary portal where the majority section is/extends diagonally to the elongated stem in its most elongated length and the minority section, in its most elongated length or a length thereof is in parallel to the elongated stem (extends at an acute angle to the majority section). When the pin is in the minority of the stem, the door display displays a locked status in embodiments of the disclosed technology. When the pin is in the majority of the stem, the door display displays an unlocked status in embodiments of the disclosed technology.

Any device or step to a method described in this disclosure can comprise or consist of that which it is a part of or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

A door handle having two sides is disclosed. A single stem extends between the two door handles such that turning one handle causes the other to turn and a door situated between the handle to be openable. A depressible (push button) lock is on one of the door handles which, when pushed rotates causing the stem to rotate and a display shown within a display window of the other door handle to rotate and change to a different display. This is accomplished, in part, based on a collar with a channel cut—therein in which a pin attached to the depressible button travels through as it is pressed, converting mechanical energy in the direction of the pressing into rotational energy in embodiments of the disclosed technology.

Embodiments of the disclosed technology will become clearer in view of the following description of the figures. Before describing the figures, a part list may aid the reader. One skilled in mechanical locks should appreciate that with the named parts and figures, the invention is largely or fully understandable.

Figure 1:
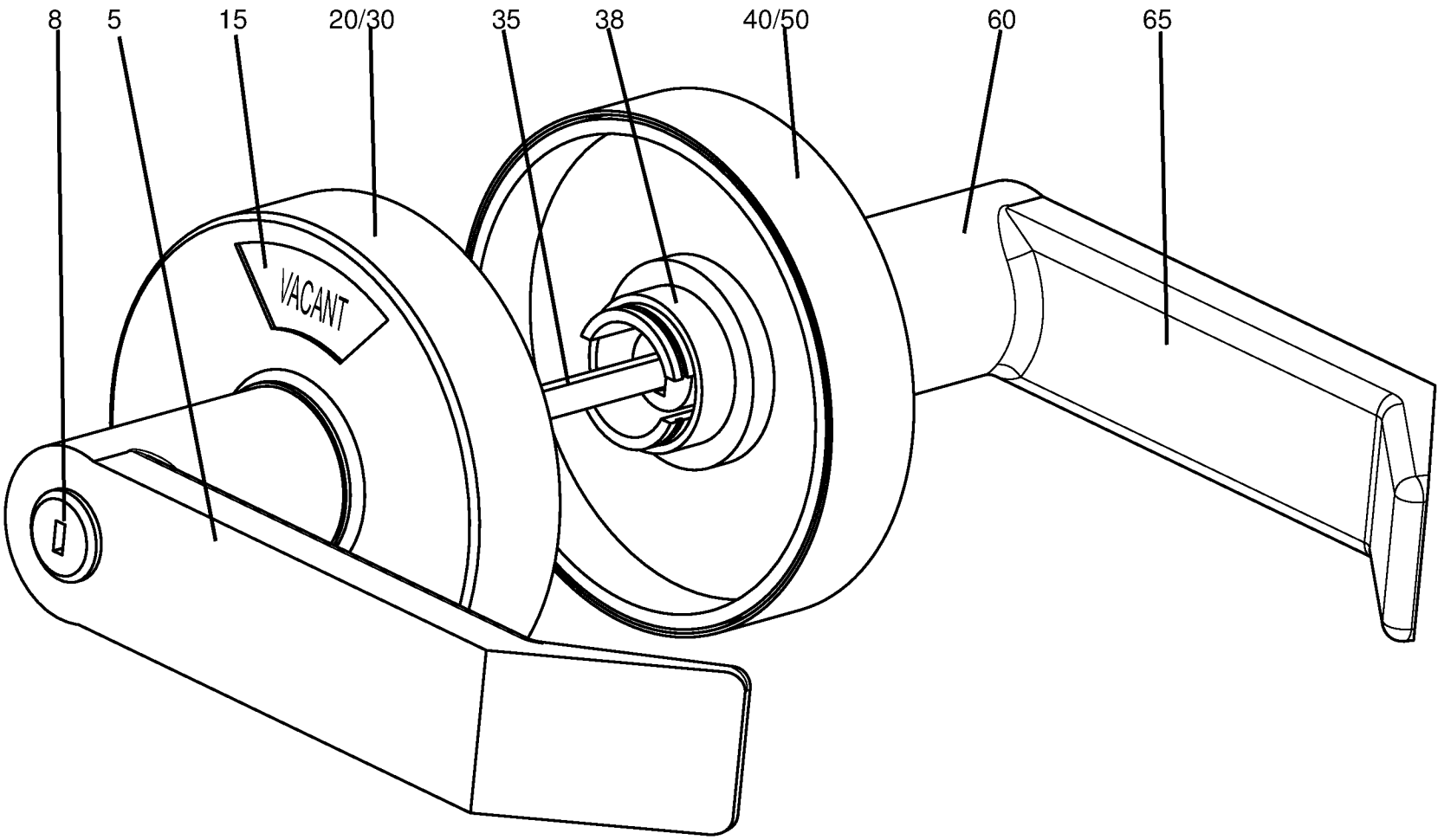
FIG. 1 is a perspective view of the door handles connected by a stem which passes through a door in an embodiment of the disclosed technology.
Figure 2:
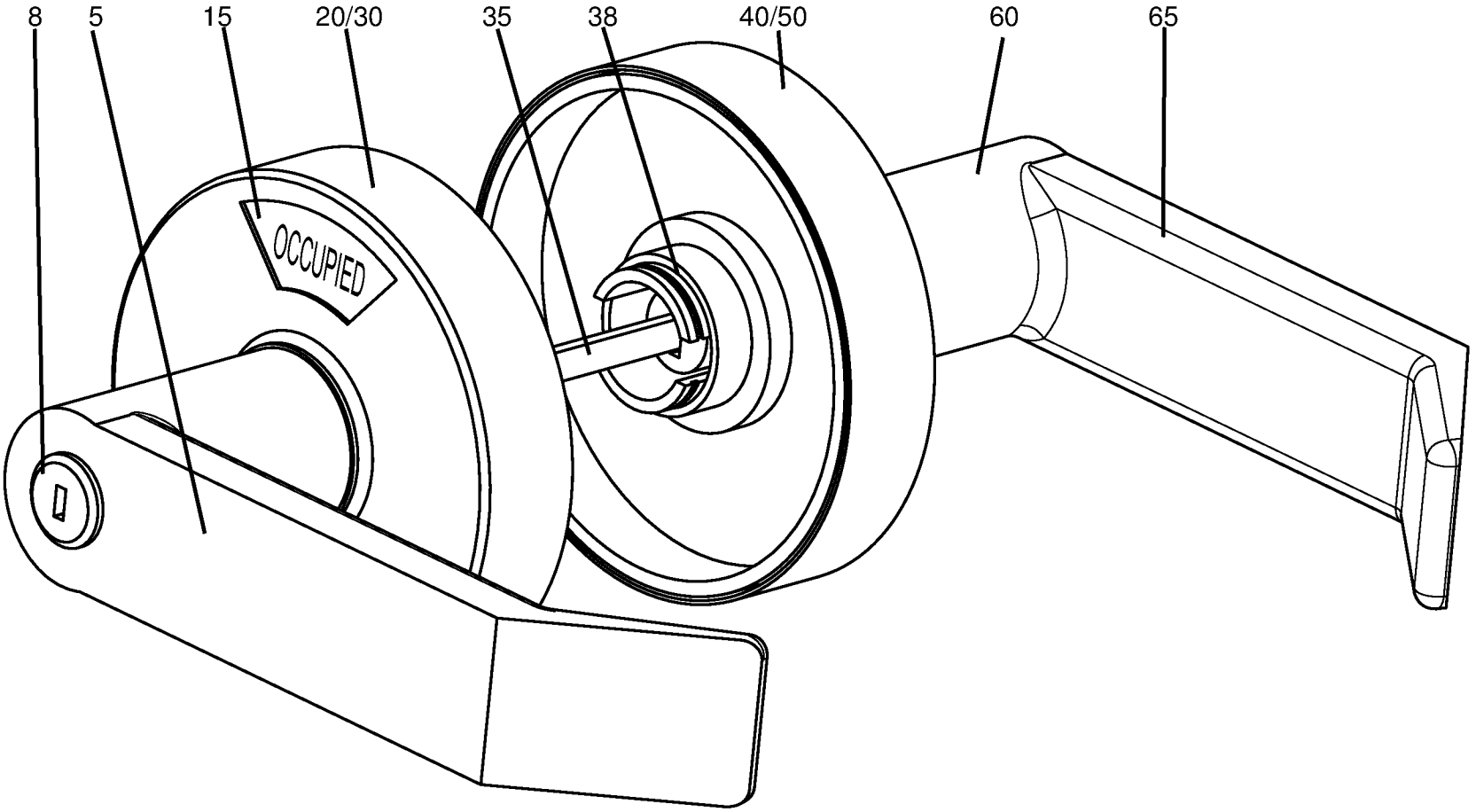
FIG. 2 is a version of the door handles of FIG. 1 in a locked configuration.

1 pin
2 curvilinear/angled channel
5 outside handle
8 outside lock
9 lock mechanism
10 outside handle stem
12 outside handle locking pin
15 display
18 outside handle collar
20 outside outer cover
22 outer stem
24 tension spring
26 outer stem larger collar
28 outer stem portal
29 attachment pin
30 outside door plate
31 outer stem smaller collar
35 shaft
38 inside door plate inner collar
40 inside door plate
42 inside inner collar
44 inside outer collar
46 tension spring
48 inside inner plate
49 inside outer plate
50 inside outer cover
60 inside handle stem
65 inside handle
68 button
100 door Moving on to the figures and discussing FIGS. 1 and 2 briefly for purposes of providing an overview, FIG. 1 is a perspective view of the door handles connected by a stem which passes through a door 100 (see FIG. 3) in an embodiment of the disclosed technology. FIG. 2 is a version of the door handles of FIG. 1 in a locked configuration. There is an outside handle 5 and an inside handle 65. On the outside handle is an outside lock 8 which is openable using a key only (inserting a key or other device into the hole to engage pins and turn the lock). An outside outer cover 20 covers an outside door plate 30, the door plate pressed against a door in embodiments of the disclosed technology. On the other side of a door one presses the inside door plate 40 against an opposite side of the door, the inside door plate being covered by an inside outer cover 50. A shaft (sometimes referred to as a stem) 35 passes through a hole/portal in a door and allows for rotation of one of the door handles 5/65 to rotate the other and/or cause the handles to be locked based on a pressing a push button 68 (see FIG. 3). There is a display window with a display 15 which, in FIG. 1 says "vacant". In FIG. 2 it says "occupied." These are examples indicating that the embodiment shown in FIG. 1 is the lock in an unlocked state (either door handle can be turned to pull an not shown piece laterally/transversely towards the shaft 35 allowing the door to open/close). In the locked state, only the inside handle 65 or a key in the outside lock 8 will be able to unlock the door.

Figure 3:
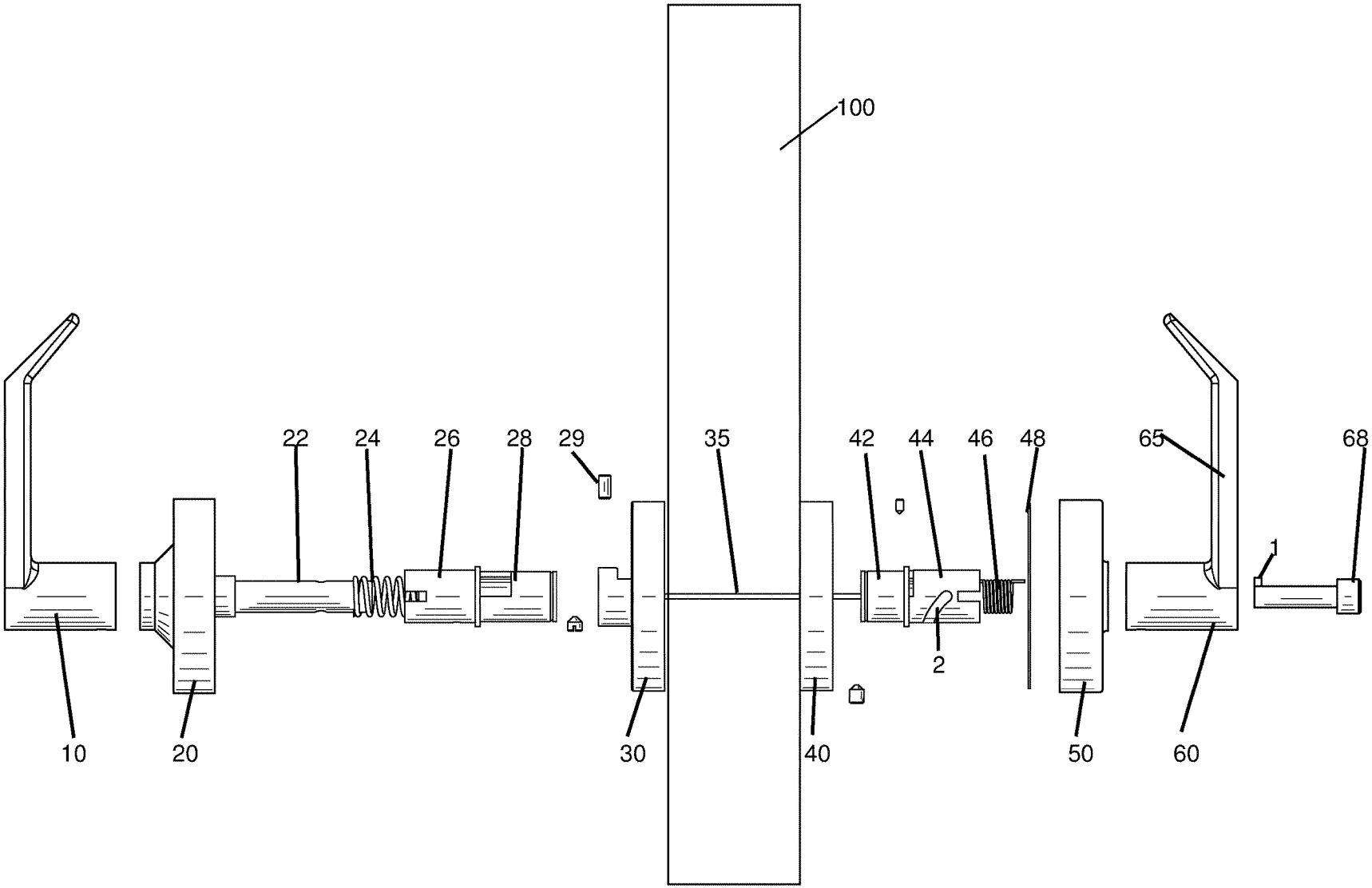
FIG. 3 is an exploded top plan view of the parts used in the door handles of embodiments of the disclosed technology.
Figure 4:
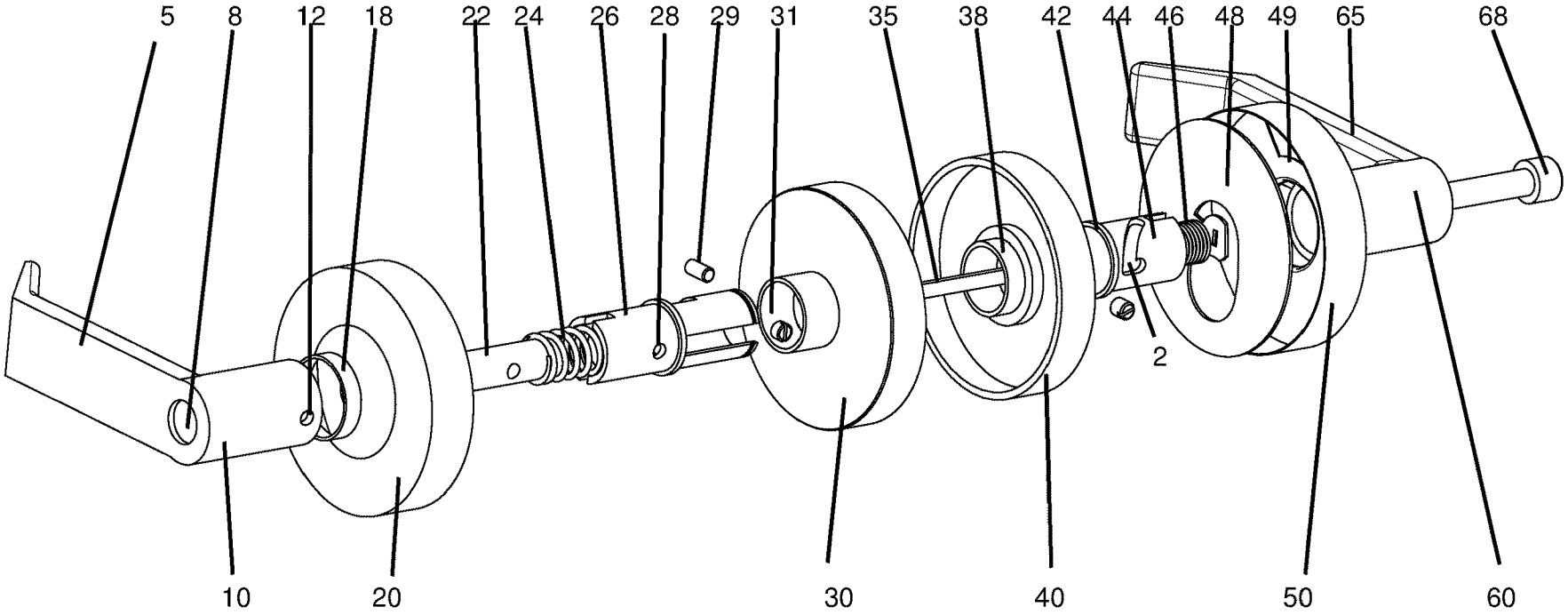
FIG. 4 is an exploded perspective view of the parts used in the door handles of embodiments of the disclosed technology.

FIGS. 3 and 4 show more detailed parts of the devices. FIG. 3 is an exploded top plan view of the parts used in the door handles of embodiments of the disclosed technology. FIG. 4 is an exploded perspective view of the parts used in the door handles of embodiments of the disclosed technology. Here the parts are divided by numbers which are multiples of 10. The outside handle stem 10 connects an outside handle to an outside outer cover by way of a outside handle locking pin which tightens the handle stem 10 to a outside handle collar. It should of course be understood that any connecting mechanism and variants of handles can be used and this is simply one way known to the inventor. The mechanical mechanism of locking and unlocking the door while having a display change using a push button is a constant in this disclosure.

Between the outside outer cover 20 and the outside door plate, at least when exploded as shown, there is an outer stem which is attached by a tension spring 24 to an outer stem larger collar having a portal 28 to attach using an attachment pin 29 to a smaller collar which, in turn, is attached inside an outer stem smaller collar 31 of the outside door plate in an embodiment of the disclosed technology. The afore-described pieces are connected together and either fixed to a door by way of fasteners and/or fixed to the inner door handle parts such as parts 40 and 50 by way of fasteners extending there-through.

Describing now the inner side of the device from the inner most side to the outside, the parts are divided between an inside handle stem 60 connecting the inside handle 65 to a inside outer cover 50 (meaning that it is the outer cover of the inside devices). An inside door plate 40 is covered by the inside outer cover 50 in embodiments of the disclosed technology and the inside door plate 40 abuts a door and is fastened through the door to the outside door plate 30 in embodiments of the disclosed technology.

The (push) button 68 is a button which is used to lock the door (temporarily disable the ability to open the door by way of rotating the outside handle 5) by pushing the button towards the door and/or towards the shaft/stem 35. That is, one pushes the button 68 "inwards". While doing so, the button 68 rotates. This will be described in more detail with reference to FIGS. 5 and 6.

Figure 5:
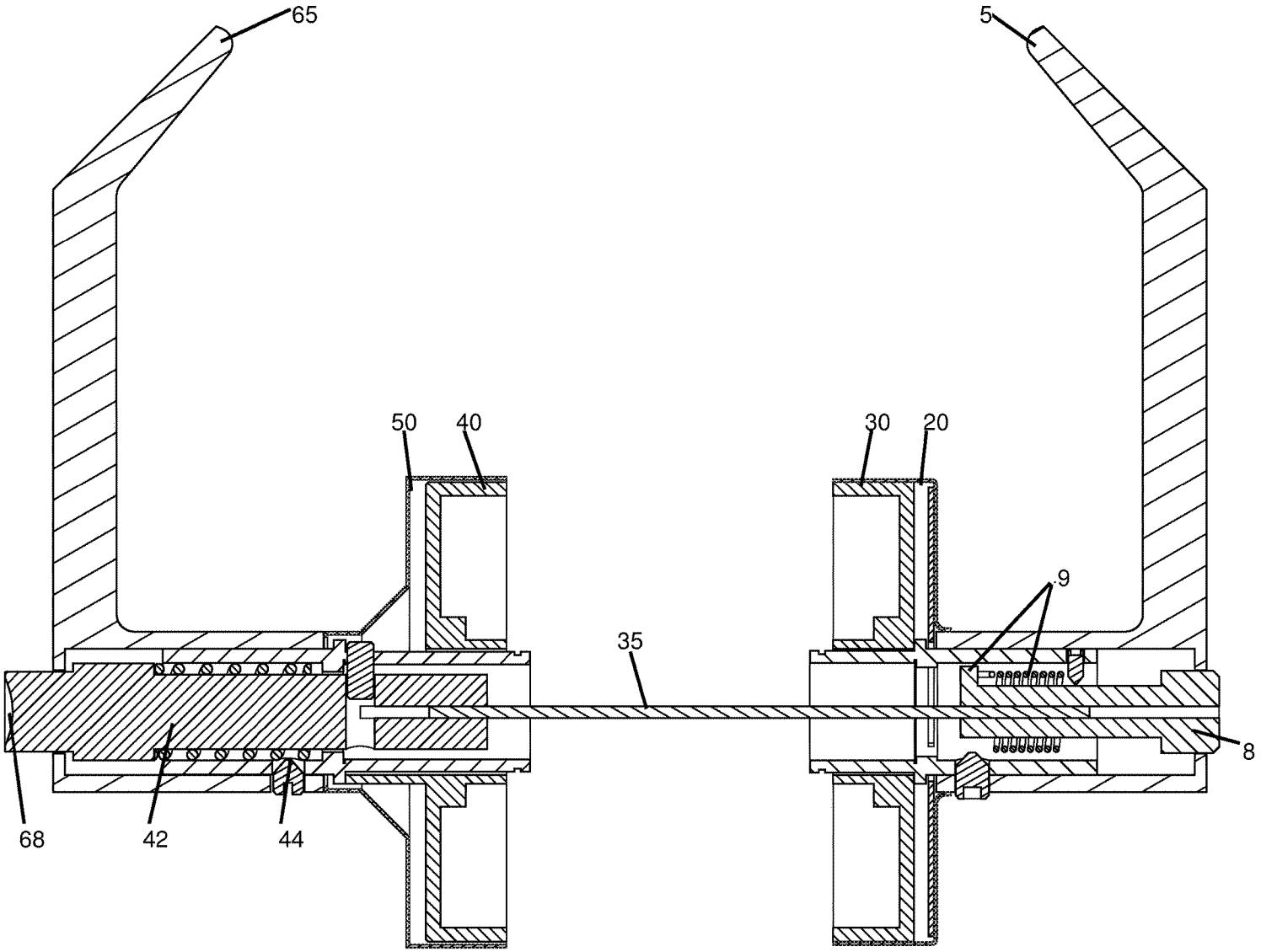
FIG. 5 is a cutaway top plan view of the parts used in the door handles of embodiments of the disclosed technology.
Figure 6:
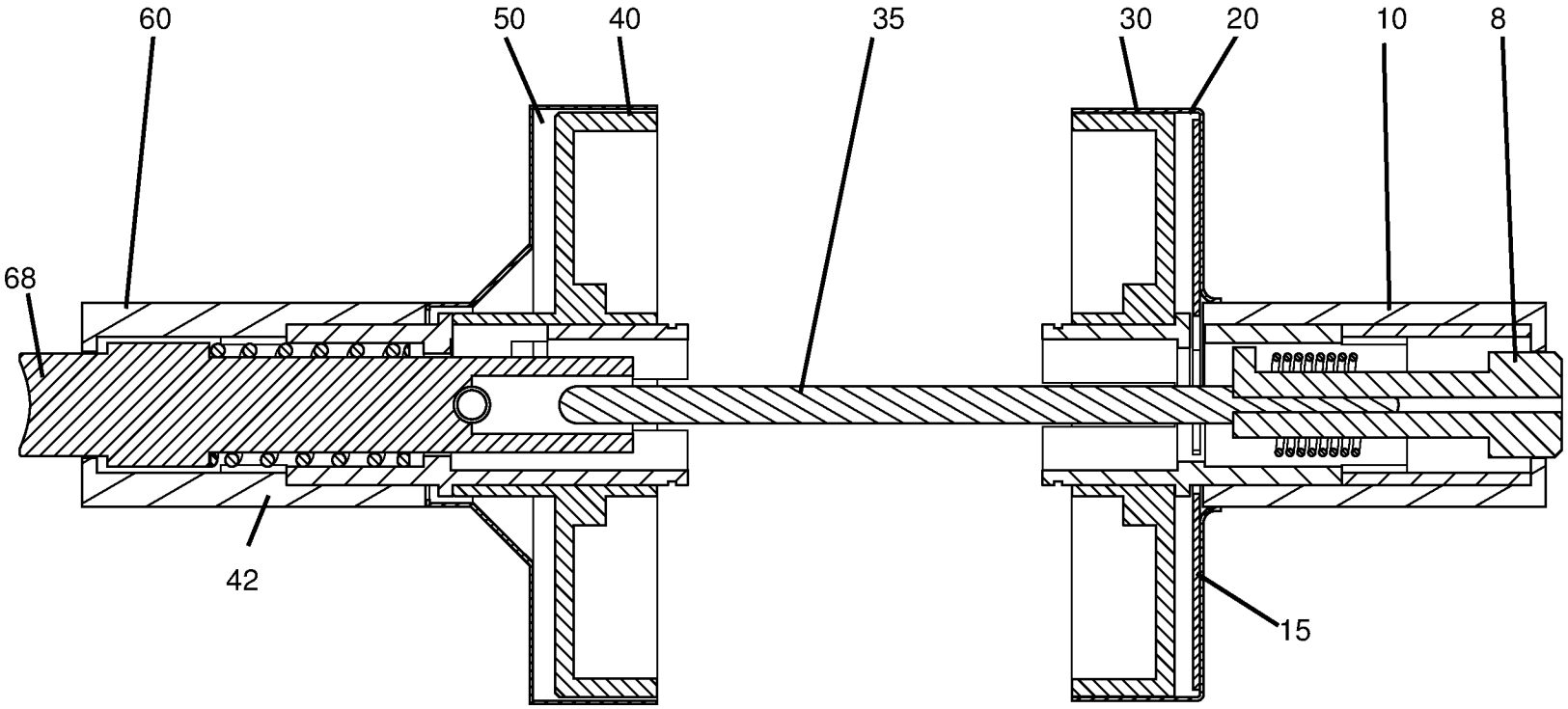
FIG. 6 is a version of the door handles of FIG. 5 in a locked condition.
Figure 7:
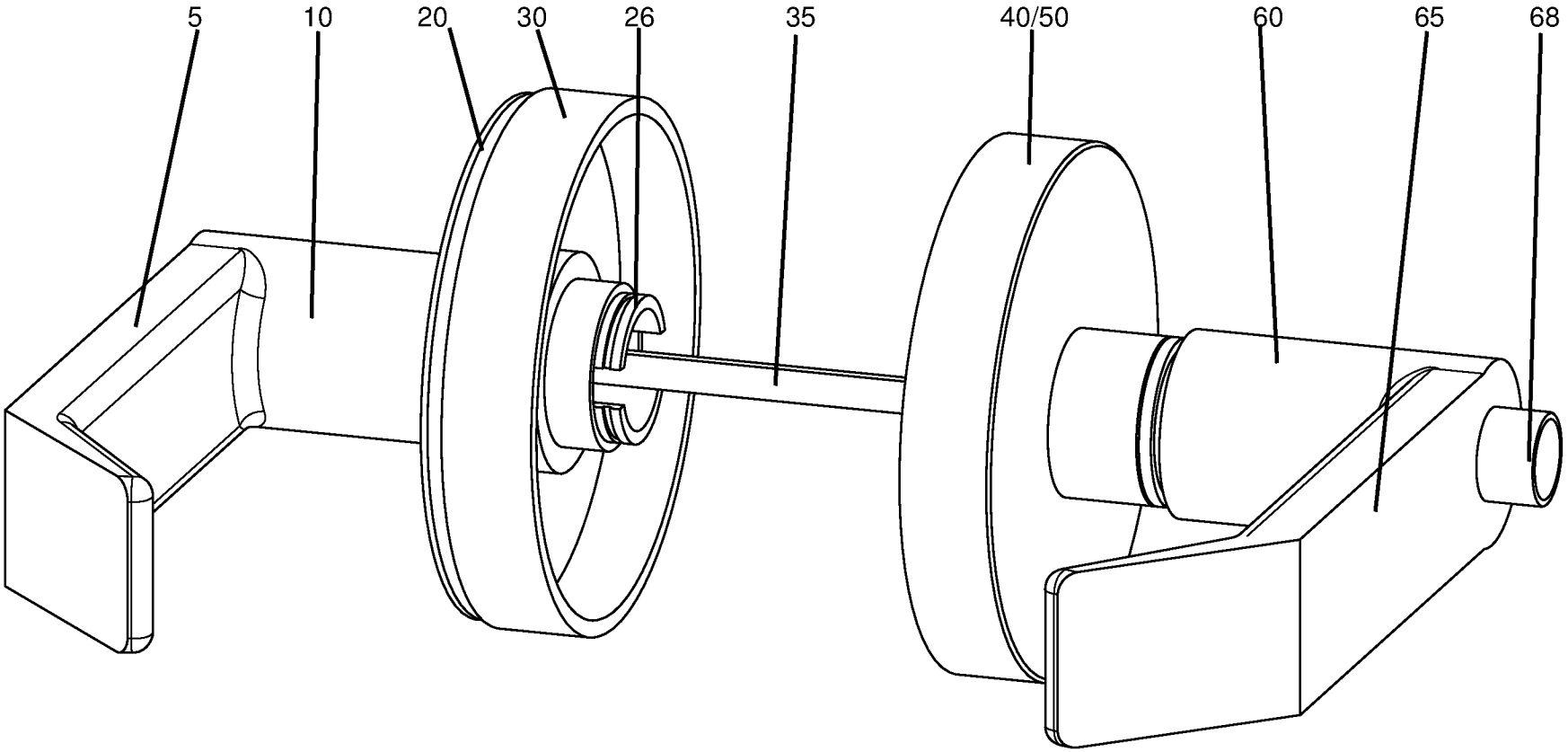
FIG. 7 is a reverse side perspective view of the door handles of FIG. 1.

FIG. 5 is a cutaway top plan view of the parts used in the door handles of embodiments of the disclosed technology. FIG. 6 is a version of the door handles of FIG. 5 in a locked condition. FIG. 7 is a reverse side perspective view of the door handles of FIG. 1. Note that the button 68 is connected to or forms a unitary structure with a longer stem such that when the push button is pushed inwards the entire stem is also pushed inwards together. A transverse pin 1 extends perpendicular to the elongated length of the rest of the push button 68.

Figure 8:
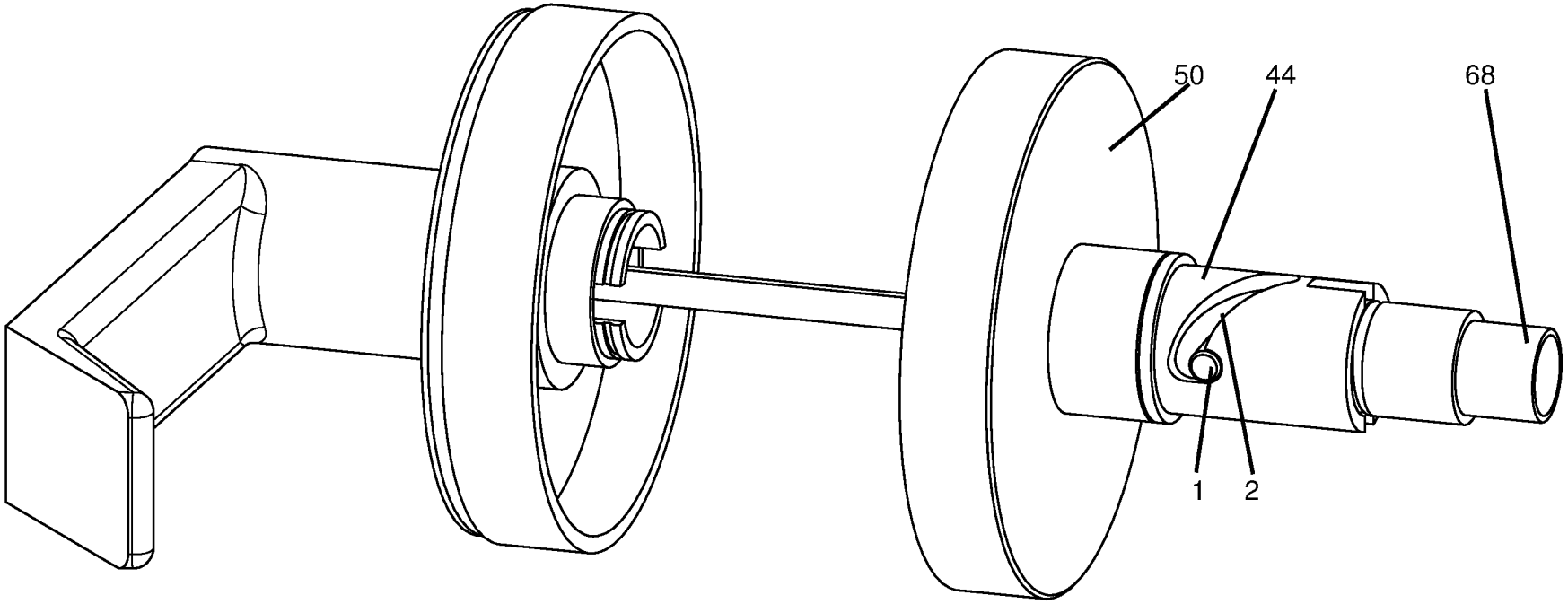
FIG. 8 is a reverse side perspective view of the door handles of FIG. 2.
Figure 9:
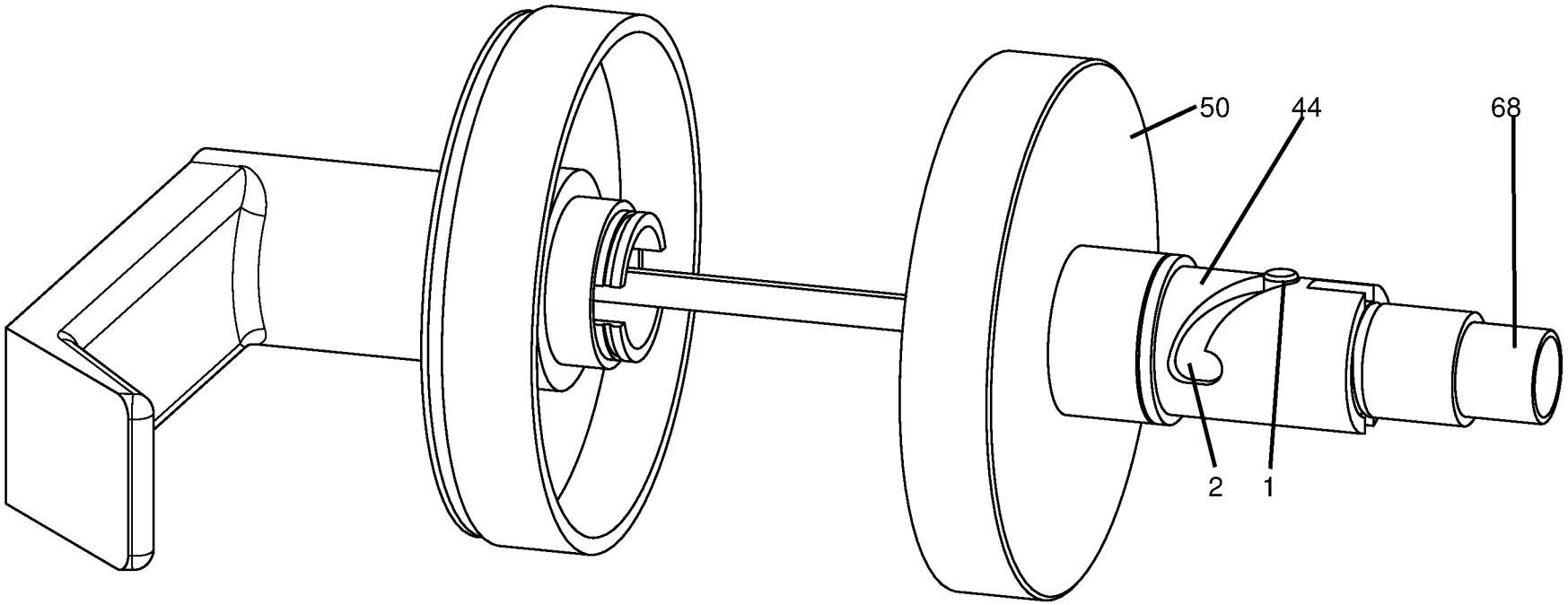
FIG. 9 shows a perspective view of the door handles with the inner door handle removed in an embodiment of the disclosed technology.
Figure 10:
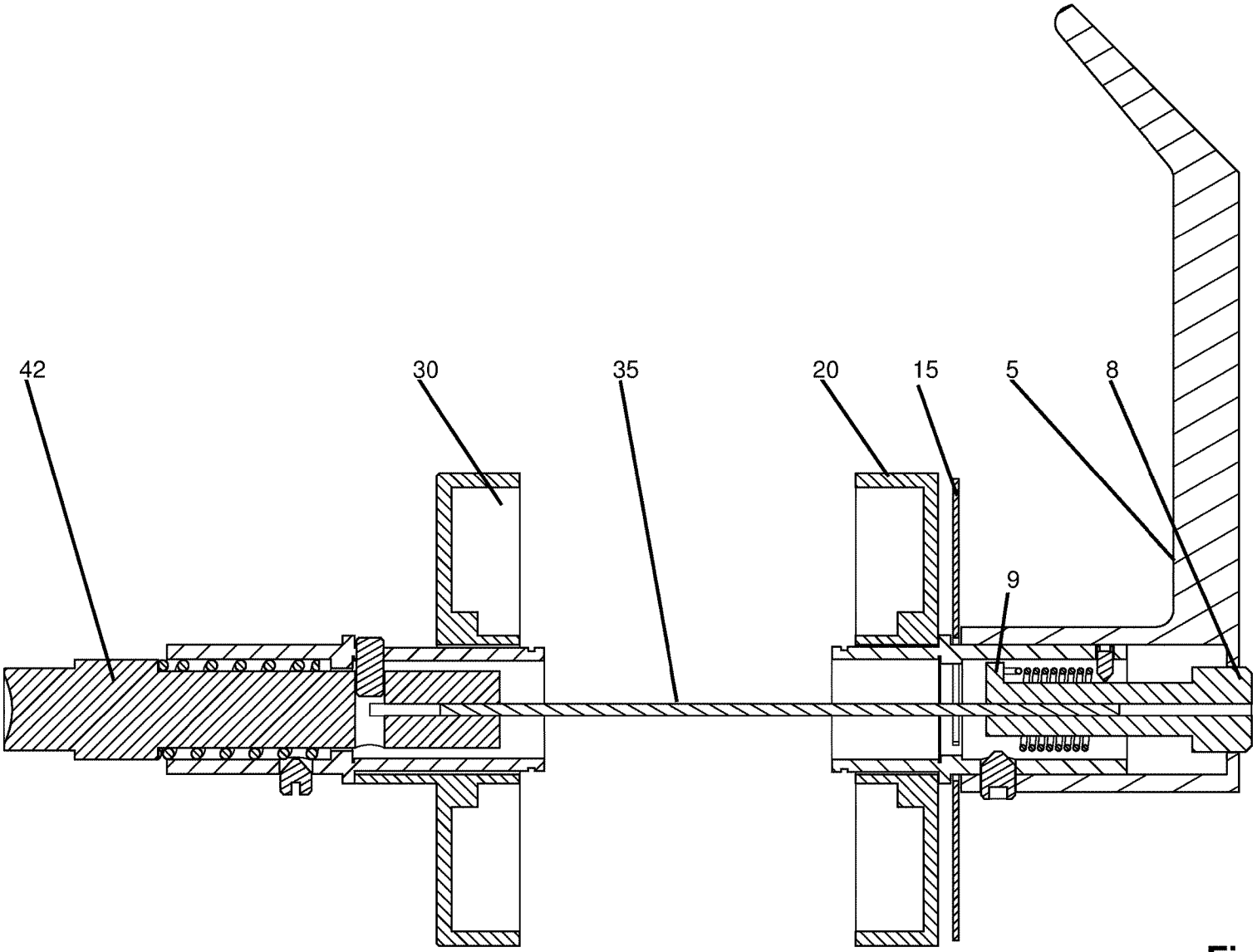
FIG. 10 shows a side cutaway view of FIG. 9.

Skipping now briefly to FIGS. 8-10, FIG. 8 is a reverse side perspective view of the door handles of FIG. 2. FIG. 9 shows a perspective view of the door handles with the inner door handle removed in an embodiment of the disclosed technology. FIG. 10 shows a side cutaway view of FIG. 9. In these Figures one can clearly see the (transverse) pin 1 of the push button 68 extending into and/or through a channel 2 of the inside inner collar 44. This inner collar 44 forms a unitary piece with, or is fixedly attached to the inside outer cover 50 which remains stationary relative to the door when the handle 65 and/or handle 5 turns. Thus, when the button 68 is pushed inward the pin 1 rotates through the channel 2. In FIG. 9 the door is unlocked. In FIG. 8 the door is locked. A majority of the channel is diagonal to the direction of the shaft 35 while a minority thereof extends in a direction parallel to the elongated shaft 35. When "extends" or a direction is used to describe a part, this refers to the most elongated region, section, or dimension thereof. Three dimensional shapes are being described and a directional indicator or the like describing same refers to a longest direction along the X, Y, or Z axis where the Z axis is into the button/along the longest length of the stem, X axis is the longest length of the handle (left to right) in a resting position, at least as shown in FIG. 8. The Y axis is transverse to these axes, such a from a bottom to top. The channel has a portion which extends along the Z axis and a portion which is diagonal to the Z axis and extends in circumferential manner into a collar, the collar being stationary while the door handle turns.

Describing the channel 2 in more detail, the channel is a portal through a circumferential collar. The channel has two sections which are acute to each other, one section being longer than the other. In the unlocked configuration of the door the pin 1 is in the channel 2 in the diagonal section thereof at a location furthest from the door and/or plane defined by the most elongated and substantially flat plane of the inside outer cover 50. When the button 68 is pressed, the pin 1 moves down through the channel 2. Recall that the channel 2 is stationary so the pin's movement through the channel is in a circumferential manner and angled such that the pin becomes closer to the door and/or afore-described plane of the outer cover 50. The rotation of the stem 35, in turn, by way of a rotationally fixed connection with a locking mechanism/handle stem 10 of on the outside then rotates Referring now to FIG. 10 in specific and the figures in general, note that the button 68 rotates the shaft 35. This connection can be fixed only along a rotational axis such that pulling apart along the Y axis would cause disconnection of the parts but grooves or the shape of the button and shaft (such as corresponding male and female parts) cause the parts to move in concert when rotated around the Z axis. Thus, as the button 68 is pushed inwards the pin 1 moves through the channel 2. The channel 2 is stationary so rotational force then causes not only the button 68 to rotate, but also the shaft 35 which is connected thereto. Ball bearings (unnumbered) between the collar 42 and 44 can aid in the rotation within the housing. The shaft 35 is, in turn connected on another side of the door 100 and passes through the door to the lock 8 and the associated pins of a locking mechanism 9. A key engages the pins and allows the rotation (unlocking) from the outside, otherwise the locking mechanism 9, as locks are known in the art, prevents the outer handle 5 from functioning to open the door.

The display 15 is part of a circular wheel in embodiments of the disclosed technology as seen through a viewing window in FIGS. 1 and 2 and in a side view in FIGS. 5, 6, and 10. This circular wheel has in different places around a circumference thereof indicia indicating the occupied/in use status versus the unoccupied/available for use status. This corresponds directly to, or displays that, a locked and unlocked status of the outer handle 5. When the door is locked, this is displayed in the display window. When it is unlocked, this is displayed in the display window. To accomplish this, the wheel with the display(s) 15 is rotationally fixed (rotates with due to mechanical linkage or attachment) with the shaft 35. When the shaft rotates, the display/wheel 15 rotate in concert. When one unlocks the door again, this causes not only the button 68 to move outwards again from the minority portion which is in parallel with the stem 35 to the majority portion which is diagonal thereto the stem and minority portion, but also for the display wheel to rotate displaying a different status of the door.

Finally, it should be understood that tension is provided in the system to give resistance to the rotational movement. As long as the pin 1 is in the acute or minority portion of the channel 2, this overcomes the rotational force which would push the lock back to the unlocked configuration with the button 68 fully extended. However, a tension spring 24 and/or 46 become more tightly wound when the door is in a locked configuration. Turning the inside handle 65 and/or the stem 35 by way of a key in the keyhole 8 releases the pin 1 from the minority portion/parallel section of the channel 2 back into the diagonal where the tension of the spring(s) and unhindered movement within the channel rotate at least the display 15, button 68, and shaft 35 back to their unlocked positions. The door handles can then be used on either side and the handles are ready to be locked again.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A door handle comprising:

an outer section with an outer handle and display window;

an inner section; and a shaft extending between said outer section and said inner section, said inner section including:

an inner handle;

a unitary piece including a depressable locking button at an end of an elongated stem with a pin extending perpendicular to a direction said locking button moves, when depressed;

a collar, covered by said inner handle; and a channel, formed in said collar, in which said pin is disposed, said channel including:

a first section having a longitudinal length which is diagonal to an elongated length of said shaft; and a second section having a longitudinal length which is parallel to said elongated length of said shaft, wherein, when said pin moves from said first section to said second section of said channel, said pin turns an acute angle, and wherein depressing said locking button rotates said shaft extending between said outer section and said inner section and a display within said display window;

wherein said channel extends circumferentially into said collar along substantially a diagonal to said direction said locking button moves when depressed; and wherein depressing said locking button causes said locking button to have simultaneous rotation and be pressed inwards, relative to a door situated between said outer section and said inner section.

2. The door handle of claim 1, further comprising a tensioning spring providing a resistive force to said rotation.

3. The door handle of claim 1, wherein said outer handle is substantially unturnable when said pin is in said section which is parallel to said elongated length of said shaft.

4. The door handle of claim 1, wherein depressing said locking button pushes said pin within said channel into said second section of said channel.

5. The door handle of claim 4, wherein rotating said inner handle causes said pin to exit from said second section of said channel and to enter into said first section of said channel and a tension spring providing resistive force causes:

said locking button to extend;

said display with said display window to turn.

6. A door handle with rotating display, comprising:

an exterior side of the door handle with a display which displays a locked or unlocked status of the door handle;

an interior side of the door handle with a push-button; and a shaft extending from said exterior side of the door handle to said interior side of the door handle, wherein said interior side of the door handle houses therein a hollow cylinder with openings at each end and a channel extending partially circumferentially around said hollow cylinder, wherein said push-button is connected to an elongated stem which further comprises a pin extending perpendicular to the elongated stem, said pin extending through said channel, wherein a longitudinal length of a majority of said channel extends at a diagonal to a longitudinal length of said elongated stem, and a longitudinal length of a minority of said channel extends in parallel to said longitudinal length of said elongated stem, wherein pushing said push-button causes a door to lock and said display to rotate to display said locked status of said door handle;

wherein said channel extends circumferentially into said hollow cylinder along substantially a diagonal to a direction said push-button moves when depressed; and wherein depressing said push-button causes said push-button to have simultaneous rotation and be pressed inwards, relative to said door situated between said outer section and said inner section.

7. The door handle of claim 6, wherein rotation of said interior side of said door handle causes simultaneously:

a) said push-button to lift away from said interior side of said door handle; and b) said display to rotate to show an unlocked status of said door.

8. The door handle of claim 7, wherein said shaft rotates with said interior side of said door handle and carries out rotational force through a door situated between said interior side of a door handle and said exterior side of said door handle.

9. The door handle of claim 6, wherein when said pin is in said minority of said channel, said door display displays a locked status.

10. The door handle of claim 6, wherein when said pin is in said majority of said channel, said door display displays an unlocked status.

* * * * *